US007322875B1

(12) United States Patent
Lou

(10) Patent No.: US 7,322,875 B1
(45) Date of Patent: Jan. 29, 2008

(54) SANDING MACHINE HAVING MALFUNCTION INDICATING DEVICE

(75) Inventor: Roger Lou, Taichung Hsien (TW)

(73) Assignee: Goign.E Machine Co., Ltd., Tantz Hsiang, Taichung (TW)

( * ) Notice: Subject to any disclaimer, the term of this patent is extended or adjusted under 35 U.S.C. 154(b) by 211 days.

(21) Appl. No.: 11/489,112

(22) Filed: Jul. 19, 2006

(51) Int. Cl.
*B24B 49/00* (2006.01)

(52) U.S. Cl. ..... 451/8; 340/679

(58) Field of Classification Search ..... 451/5, 451/8, 9, 10; 340/679, 680
See application file for complete search history.

(56) References Cited

U.S. PATENT DOCUMENTS 3,656,139 A * 4/1972 Wintriss ..... 340/506
4,080,759 A * 3/1978 Klar et al. ..... 451/8
4,154,024 A * 5/1979 Rajczi ..... 451/8
6,342,000 B1 1/2002 Yan ..... 451/304
6,368,183 B1 * 4/2002 Trojan et al. ..... 451/8

* cited by examiner

*Primary Examiner*—Jacob K. Ackun, Jr.
(74) *Attorney, Agent, or Firm*—Charles E. Baxley

(57) ABSTRACT

A sanding machine includes a number of machine elements, a number of sensors attached to the machine elements respectively, a malfunction indicating device having a graph disposed on a front panel for showing the machine elements, and a number of indicating members disposed on the front panel and coupled to the sensors for detecting malfunctions of the machine elements and for detecting whether the machine elements may not be operated or have become failed or have been damaged or not, and for allowing the malfunction areas to be easily and quickly found and repaired by the workers or the users.

7 Claims, 4 Drawing Sheets

SANDING MACHINE HAVING MALFUNCTION INDICATING DEVICE

BACKGROUND OF THE INVENTION

1. Field of the Invention

The present invention relates to a sander or sanding machine, and more particularly to a sanding machine including a malfunction indicating device having a number of indicating lights or members for indicating various or different malfunction areas of the sanding machine and for allowing the malfunction areas to be easily and quickly found and repaired.

2. Description of the Prior Art

Typical sanders or sanding machines comprise one or more sander members rotatably disposed or received in an outer housing, and one or more motor driving devices coupled to the sander members respectively with complicated coupling or transmission mechanisms.

For example, U.S. Pat. No. 6,342,000 to Yan discloses one of the typical sanding machines comprise a number of members or elements or parts disposed or received in an outer housing and/or a stand. Normally, when the typical sanding machines may not be operated or have become failed or have been damaged, the workers have to open the outer housing in order to search and to find out where the malfunction areas are located.

However, it may take a long time to search and to find out where the malfunction areas are located before the typical sanding machines may be repaired.

The present invention has arisen to mitigate and/or obviate the afore-described disadvantages of the conventional sanding machines.

SUMMARY OF THE INVENTION

The primary objective of the present invention is to provide a sanding machine including a malfunction indicating device having a number of indicating lights or indicating members for indicating various or different malfunction areas of the sanding machine and for allowing the malfunction areas to be easily and quickly found and repaired.

In accordance with one aspect of the invention, there is provided a sanding machine comprising a number of machine elements, a number of sensors attached to the machine elements respectively, a malfunction indicating device including a front panel having a graph provided thereon for showing the machine elements, and a number of indicating members provided on the front panel and coupled to the sensors for detecting malfunctions of the machine elements and for detecting whether the machine elements may not be operated or have become failed or have been damaged or not.

The indicating members may be the indicating lights or the like. The front panel includes a number of points provided thereon and coupled to the indicating members.

The malfunction indicating device includes a casing attached to the front panel and having a number of terminals coupled to the sensors respectively. A housing is provided for receiving the machine elements, and a control box is attached to the housing and includes a space formed therein for receiving the casing of the malfunction indicating device.

The malfunction indicating device includes a socket attached to a first sensor of the sensors, the housing includes a door pivotally attached thereto, and a latch attached to the door for engaging with the socket and for indicating whether the door has been closed not. The control box includes at least one indicating member attached thereto and coupled to the first sensor.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
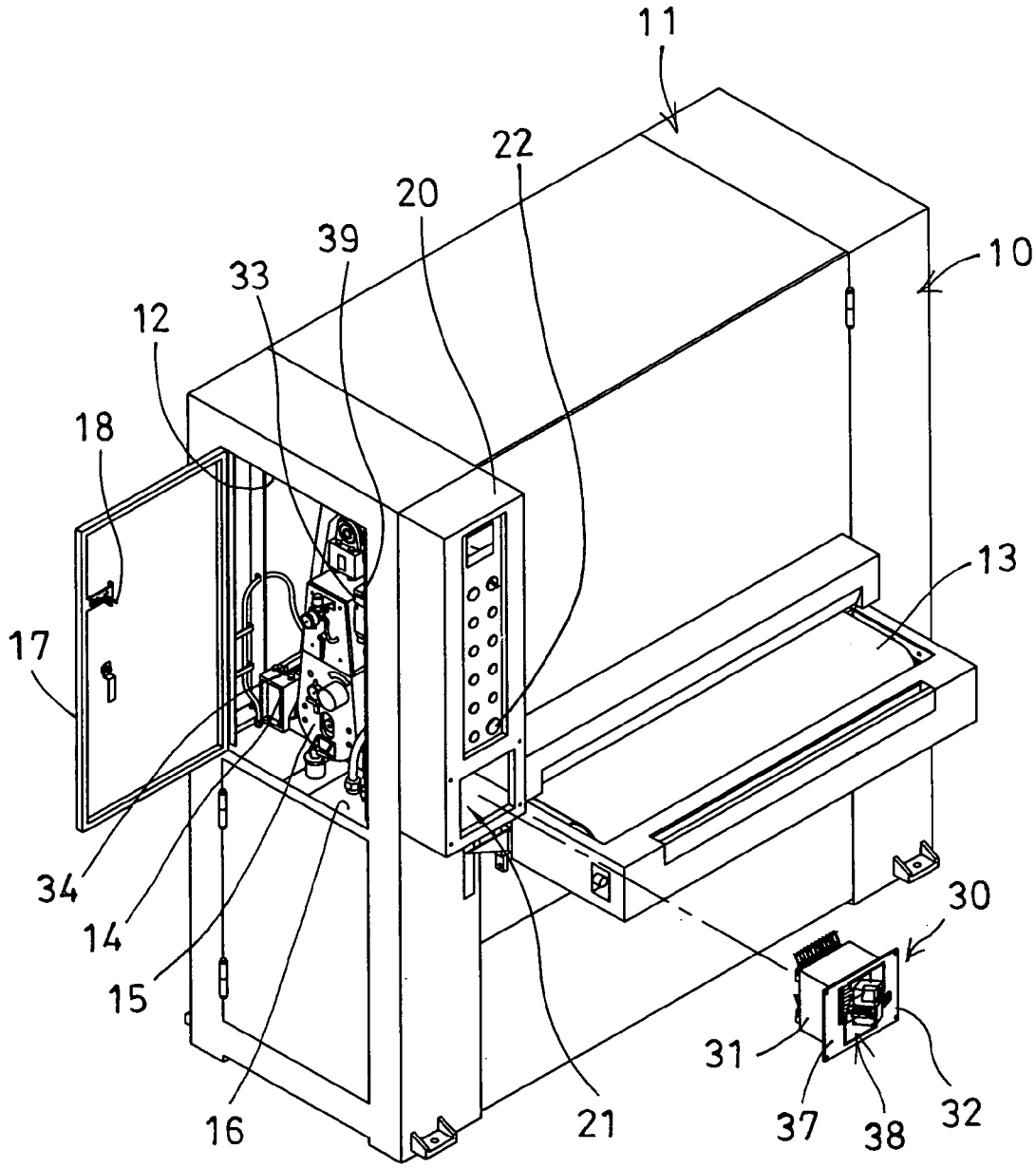
FIG. 1 is a partial exploded view of a sanding machine in accordance with the present invention.

Referring to the drawings, and initially to FIG. 1, a sanding machine 10 in accordance with the present invention comprises an outer housing 11 having a chamber 12 formed therein for receiving various members or parts or machine elements 13-15, such as one or more typical sander members 13, one or more typical motor driving devices 14, and/or one or more typical coupling or transmission mechanisms 15, the outer housing 11 includes an opening 16 formed therein and communicating with the chamber 12 thereof for allowing the members or parts or machine elements 13-15 to be reached by the users. It is preferable that the outer housing 11 includes a door 17 pivotally attached thereto for selectively enclosing the opening 16 thereof.

Figure 2:
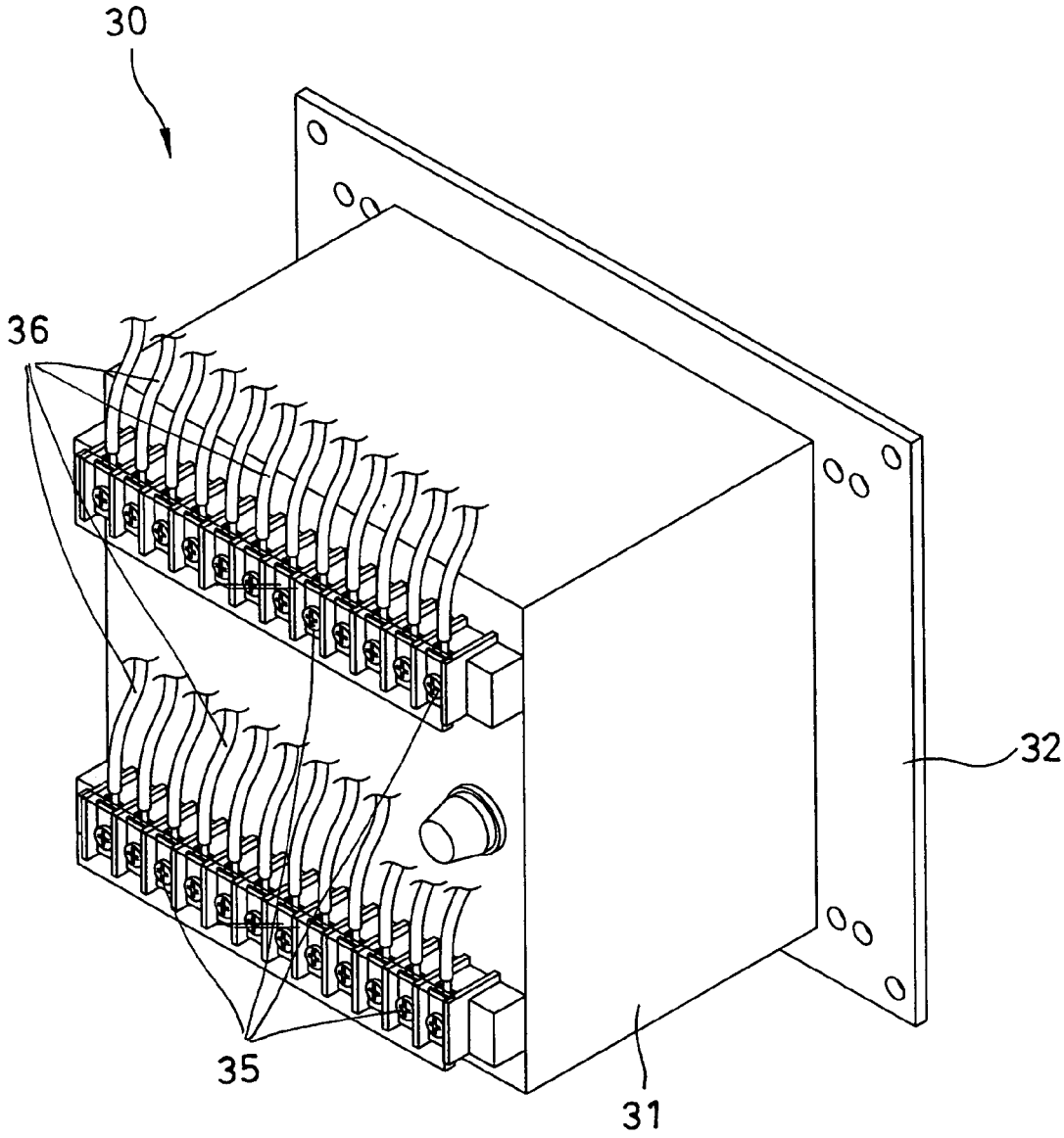
FIG. 2 is a rear perspective view of a malfunction indicating device for the sanding machine.

A control box 20 is provided and attached to such as the front portion of the outer housing 11 and includes a space 21 formed therein for attaching or for receiving a malfunction indicating device 30 in accordance with the present invention. As shown in FIGS. 1 and 2, the malfunction indicating device 30 includes a casing 31 for engaging into the space 21 of the control box 20, and a front panel 32 attached to the casing 31 for securing to the control box 20 with such as latches or fasteners (not shown), or by welding processes, and a number of detectors or sensors 33, 34 attached to the machine elements 13-15 for detecting the malfunctions of the machine elements 13-15 or for detecting whether the machine elements 13-15 may not be operated or have become failed or have been damaged or not, and a number of terminals 35 attached to or provided on the rear portion of the casing 31 and electrically coupled to the detectors or sensors 33, 34 with electrical wires or cables 36 respectively.

Figure 3:
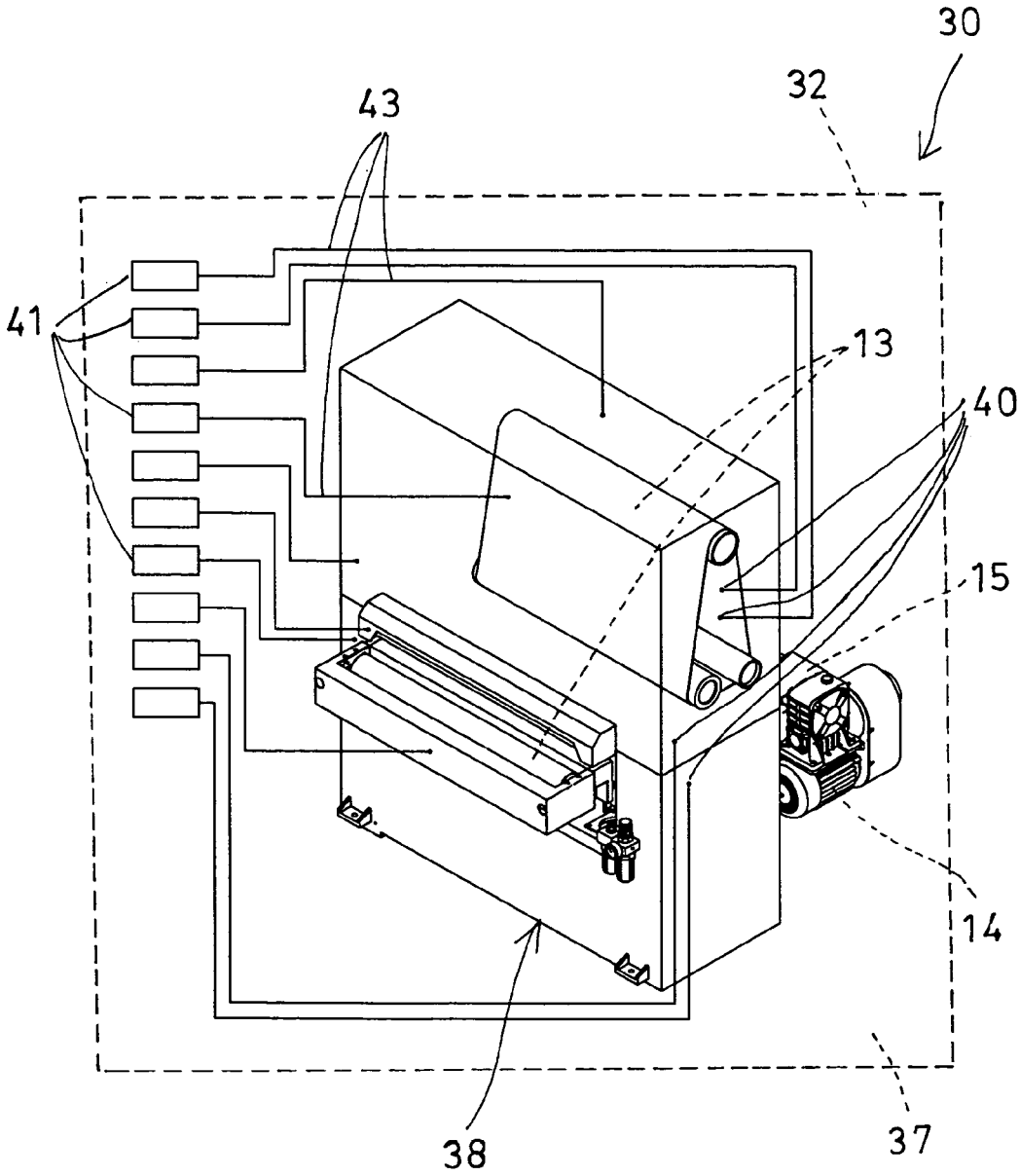
FIG. 3 is a front plan schematic view illustrating a front panel of the sanding machine.

The malfunction indicating device 30 further includes a picture or graph 38 formed or provided on the front portion of the front panel 32 of the casing 31 (FIGS. 1, 3-4), for showing or indicating the shapes or the contours or the positions of the various machine elements 13-15, in which the graph 38 includes a number of dots or points 40 provided thereon (FIG. 3) for showing or indicating the various machine elements 13-15 having the detectors or sensors 33, 34 attached thereto, and a number of indicating members 41, such as indicating lights 41 attached or provided on the front portion of the front panel 32 of the casing 31 and coupled to the dots or points 40 with indicating lines 43, for indicating the corresponding machine elements 13-15 with the indicating members or indicating lights 41 respectively.

Figure 4:
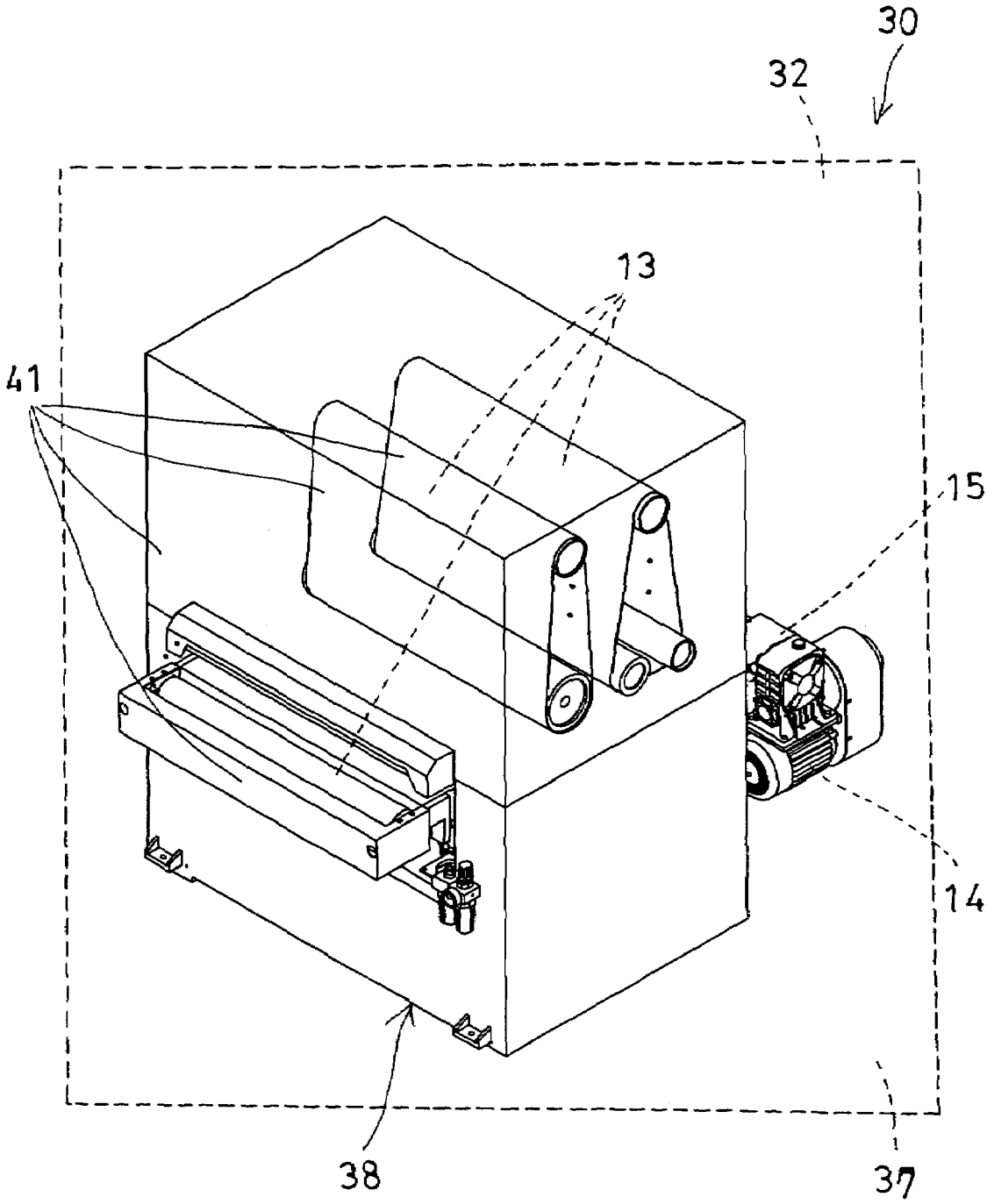
FIG. 4 is a front plan schematic view similar to FIG. 3, illustrating the other arrangement of the sanding machine.

It is to be noted that the indicating members 41 may be directly and electrically coupled to the terminals 35 and/or directly and electrically coupled to the detectors or sensors 33, 34 with the electrical wires or cables 36 respectively, or indirectly coupled to the terminals 35 with a processor device (not shown). Alternatively, as shown in FIG. 4, the indicating members or indicating lights 41 may be directly attached to the portions of the graph 38 that corresponds to the machine elements 13-15 of the sanding machine 10 for indicating the malfunction areas of the sanding machine 10 when the indicating members or indicating lights 41 have been energized or actuated, and thus for allowing the malfunction areas to be easily and quickly found and repaired by the workers or the users.

In operation, when the detectors or sensors 33, 34 has sensed or detected that one or more of the machine elements 13-15 of the sanding machine 10 may not be operated or have become failed or have been damaged, either or some of the indicating members or indicating lights 41 may be energized or actuated to clearly indicate where the malfunction positions or areas are located, and thus to allow the malfunction areas to be easily and quickly found and repaired by the workers or the users.

For example, as shown in FIG. 1, one of the detectors or sensors 33 includes a socket 39 attached or coupled thereto, and the door 17 of the outer housing 11 includes a latch 18 attached thereto for engaging into the socket 39 and for indicating whether the door 17 has been closed or engaged with the outer housing 11 or not, and for actuating the detector or sensor 33 and thus one of the indicating members or indicating lights 41 when the door 17 has been detected to be not suitably closed or engaged with the outer housing 11. The control box 20 may further include one or more further indicating members 22, such as indicating lights 22 attached or provided on the front portion thereof and coupled to the detector or sensor 33 or the socket 39 for indicating whether the door 17 has been closed or engaged with the outer housing 11 or not.

Accordingly, the sanding machine in accordance with the present invention includes a malfunction indicating device having a number of indicating lights or indicating members for indicating various or different malfunction areas of the sanding machine and for allowing the malfunction areas to be easily and quickly found and repaired.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A sanding machine comprising:

a plurality of machine elements, a plurality of sensors attached to said machine elements respectively, a malfunction indicating device including a front panel having a graph provided thereon for showing a contour of said sanding machine and for indicating a position of said machine elements in said sanding machine, and a plurality of indicating members provided on said front panel and coupled to said sensors for detecting malfunctions of said machine elements and for detecting whether said machine elements may not be operated or have become failed or have been damaged or not and for indicating the position of said malfunctioning machine elements in said sanding machine and for allowing said malfunctioning machine elements in said sanding machine to be quickly located and found.

2. The sanding machine as claimed in claim 1, wherein said indicating members are indicating lights.

3. The sanding machine as claimed in claim 1, wherein said front panel includes a plurality of points provided thereon and coupled to said indicating members.

4. The sanding machine as claimed in claim 1, wherein said malfunction indicating device includes a casing attached to said front panel and having a plurality of terminals coupled to said sensors respectively.

5. The sanding machine as claimed in claim 4, wherein a housing is provided for receiving said machine elements, and a control box is attached to said housing and includes a space formed therein for receiving said casing of said malfunction indicating device.

6. The sanding machine as claimed in claim 5, wherein said malfunction indicating device includes a socket attached to a first sensor of said sensors, said housing includes a door pivotally attached thereto, and a latch attached to said door for engaging with said socket and for indicating whether said door has been closed not.

7. The sanding machine as claimed in claim 6, wherein said control box includes at least one indicating member attached thereto and coupled to said first sensor.

* * * * *